US009455097B2

(12) United States Patent
Chen

(10) Patent No.: US 9,455,097 B2
(45) Date of Patent: Sep. 27, 2016

(54) KEY STRUCTURE WITH TWO PAIRS OF SYMMETRIC BALANCE PLATES

(71) Applicant: LITE-ON TECHNOLOGY CORPORATION, TAIPEI (TW)

(72) Inventor: Chun-Lin Chen, New Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 14/825,254

(22) Filed: Aug. 13, 2015

(65) Prior Publication Data

US 2016/0147312 A1 May 26, 2016

(30) Foreign Application Priority Data

Nov. 24, 2014 (TW) ..... 103220808 U

(51) Int. Cl.
*H01H 3/12* (2006.01)
*H01H 13/7065* (2006.01)

(52) U.S. Cl.
CPC ..... *H01H 3/125* (2013.01); *H01H 3/122* (2013.01); *H01H 13/7065* (2013.01); *H01H 2209/01* (2013.01); *H01H 2221/058* (2013.01)

(58) Field of Classification Search
CPC ..... H01H 3/122; H01H 3/125; H01H 2237/002; H01H 2237/004; H01H 2209/01; H01H 2201/058; H01H 13/7065
See application file for complete search history.

(56) References Cited

U.S. PATENT DOCUMENTS

2010/0294340 A1* 11/2010 Cunningham ..... F24J 2/4614 136/251
2011/0303521 A1* 12/2011 Niu ..... H01H 3/122 200/517
2014/0231234 A1* 8/2014 Hsu ..... H01H 13/52 200/5 A
2014/0318942 A1* 10/2014 Takemae ..... H01H 3/125 200/5 A

FOREIGN PATENT DOCUMENTS

JP 11039995 A * 2/1999

* cited by examiner

*Primary Examiner* — Daniel J Colilla
(74) *Attorney, Agent, or Firm* — Li & Cai Intellectual Property (USA) Office

(57) ABSTRACT

A key structure comprises a bottom board, a key cap and two first balance plates. The two first balance plates are plate shaped, disposed between the bottom board and the key cap, and symmetric to each other. An upper end of each of the two first balance plates is connected to the key cap. A lower end of each of the two first balance plates is connected to the bottom board. Thereby, a key structure is formed which provides a normal tactile feel while saving space, thereby achieving a slim design.

14 Claims, 5 Drawing Sheets

KEY STRUCTURE WITH TWO PAIRS OF SYMMETRIC BALANCE PLATES

BACKGROUND OF THE INVENTION

1. Field of the Invention

The present disclosure relates to a key structure; in particular, to a key structure having a balance mechanism which occupies little space.

2. Description of Related Art

In conventional keyboards, function keys which are longer in one direction than they are in another (e.g. length significantly greater than width) use link bars for balance. A link bar has a circular cross section, is linear and is made of stainless steel. One end of the link bar is pivotally connected to a key cap. Another end of the link bar is slidably disposed on a bottom board. When the key is pressed, the link bar slides on the bottom board and pivots about the key cap, keeping the key cap horizontal to the bottom board. The key cap is prevented from flipping and being unresponsive.

With development of lightweight electronic products, the keyboards thereof are also trending toward slim designs. Thicker link bars (0.8 mm to 0.9 mm) are required to provide sufficient strength for preventing corners of a key cap from being unresponsive to a stroke. However, thicker bars require more space. Specifically, conventional keys have heights of over 3 mm. Therefore, traditional link bars compromises the design of a super thin keyboard.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a key structure which saves space while maintaining a normal tactile feel.

In order to achieve the aforementioned objects, the present disclosure provides a key structure comprising: a bottom board; a key cap; and two first balance plates. The two first balance plates are plate shaped (flat and tabular), are disposed between the bottom board and the keycap, and are symmetric to each other. An upper end of each of the two first balance plates is connected to the key cap, and a lower end of each of the two first balance plates is connected to the bottom board.

The present disclosure has the following advantages. The tabular design of the balance plates provides greater strength in a same amount of space compared to traditional link bars having circular cross sections. A normal tactile feel is provided while saving space, thereby achieving a slim design.

Moreover, a strengthening plate can be disposed under the key cap for increasing the strength of the key cap, such that the key cap is not easily damaged.

In order to further the understanding regarding the present disclosure, the following embodiments are provided along with illustrations to facilitate the disclosure of the present disclosure.

DETAILED DESCRIPTION OF THE PREFERRED EMBODIMENTS

Figure 1:
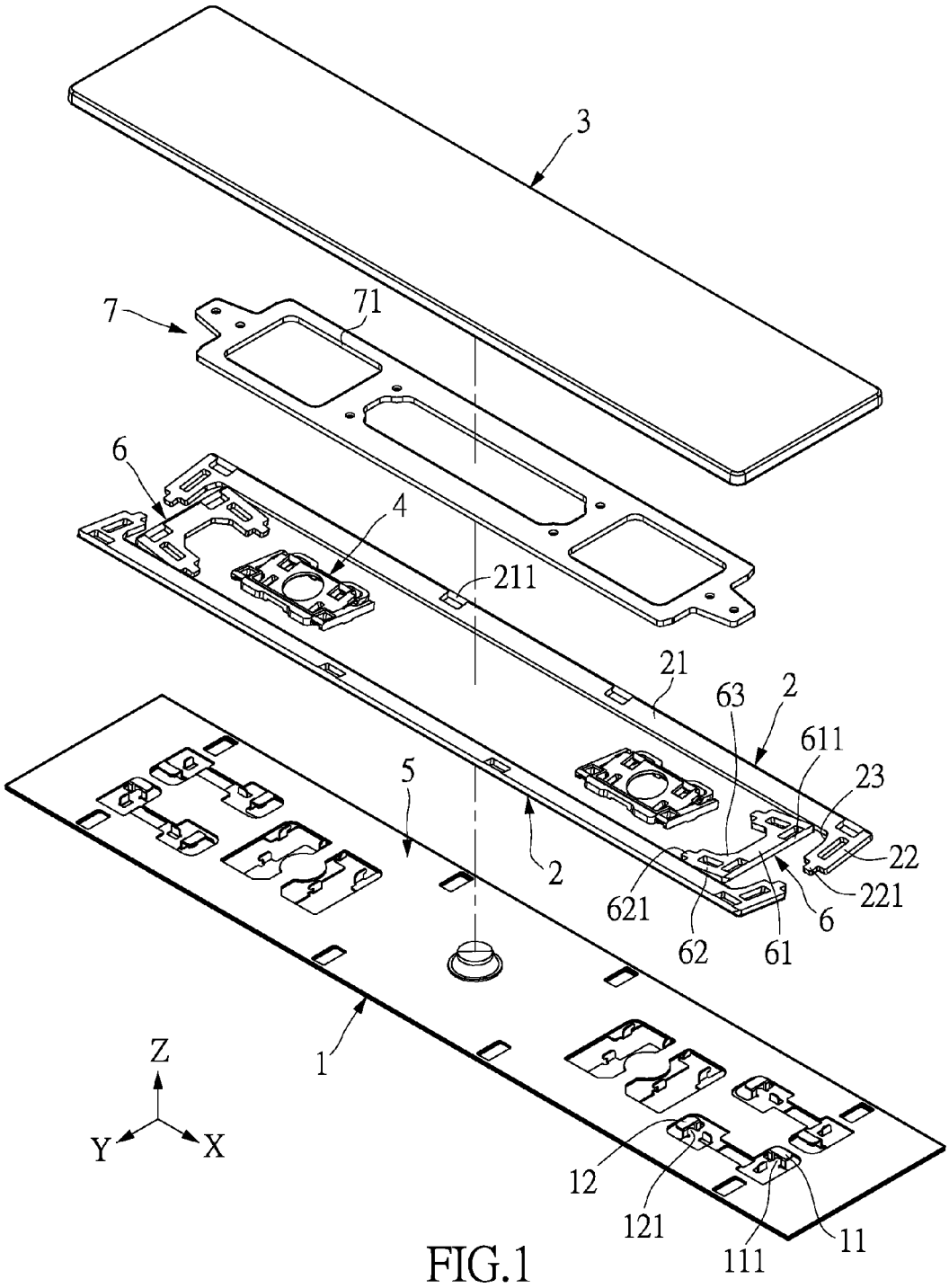
FIG. 1 shows an exploded view of a key structure according to the present disclosure.
Figure 2:
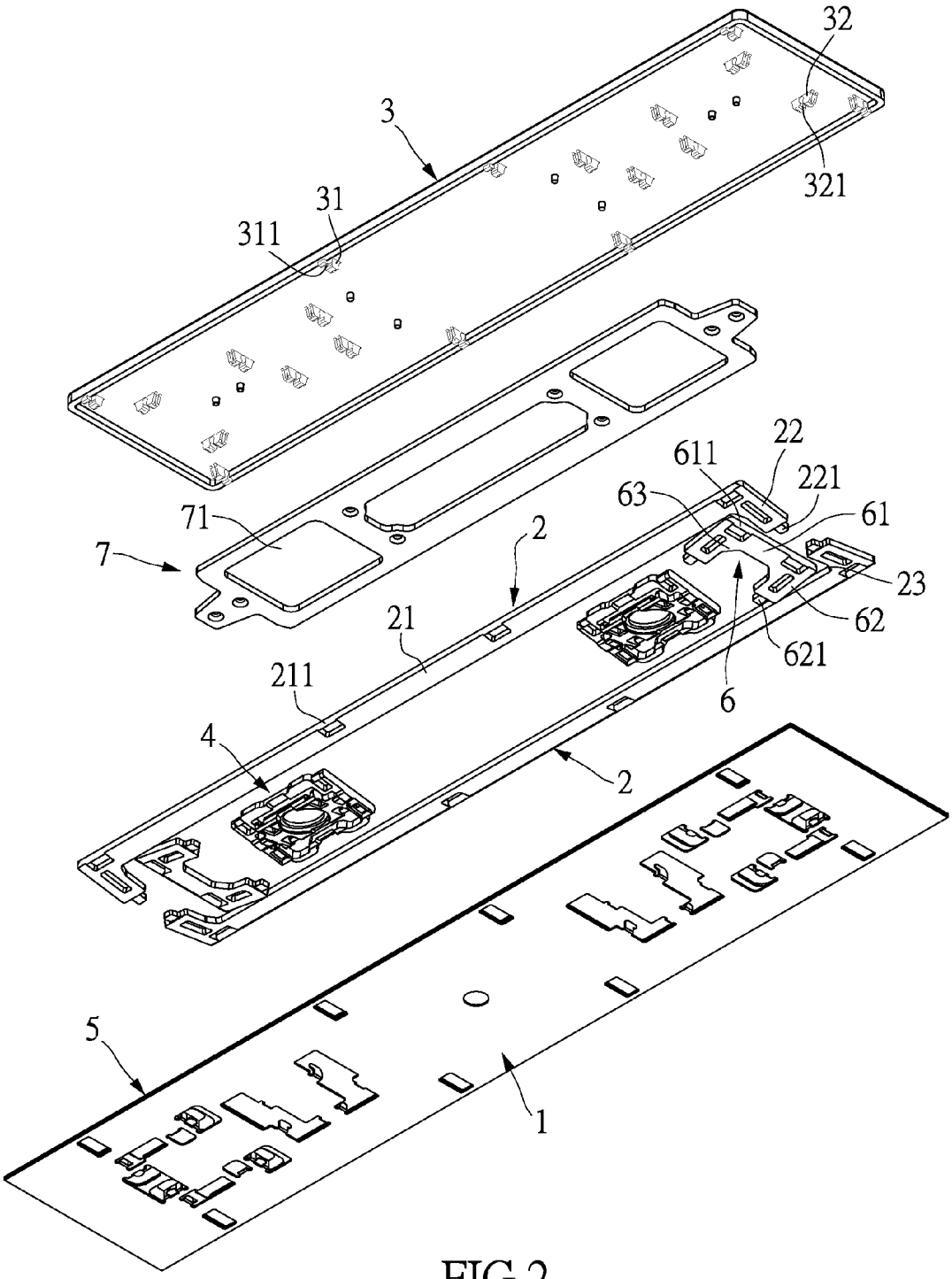
FIG. 2 shows an exploded view from another perspective of a key structure according to the present disclosure.

Referring to FIG. 1 and FIG. 2, the present disclosure provides a key structure applicable to function keys or other keys, including a bottom board 1, two first balance plates 2, and a key cap 3. The bottom board 1 can be made of metal or other suitable materials. A scissor switch 4 can be disposed between the bottom board 1 and the key cap 3. The scissor switch 4 is a two-bar balance structure which can guide the key cap 3 in up and down motions and balance the force applied to the key cap 3 by a user. A conductive thin film 5 can be disposed on the bottom board 1. In the present embodiment, the bottom board 1 and the conductive thin film 5 are shown as an individual unit for each key structure. In practice, a keyboard has a plurality of key structures, and the bottom boards 1 of the key structures are connected as one body, and the conductive thin films 5 of the key structures are likewise connected as one body.

The two first balance plates 2 are preferably metal plates (e.g. stainless steel) but are not limited thereto. The two first balance plates 2 can be elongated corresponding to the length of the key cap 3. The thickness of the first balance plates 2 is preferably 0.3 mm to 0.6 mm but is not limited thereto. The two first balance plates 2 are disposed between the bottom board 1 and the key cap 3, and are symmetric to each other. An upper end of each of the two first balance plates 2 is connected to the key cap 3, and a lower end of each of the two first balance plates 2 is connected to the bottom board 1. In the present embodiment, the upper end of each of the two first balance plates 2 is pivotally connected to the key cap 3, and the lower end of each of the two first balance plates 2 is slidably connected to the bottom board 1. However, the method of connection between the two first balance plates 2 and the bottom board 1 and between the two first balance plates 2 and the key cap 3 is not limited and can be modified according to need. For example, the upper ends of the two first balance plates 2 can be slidably connected to the key cap 3, and the lower ends of the two first balance plates 2 can be pivotally connected to the bottom board 1.

In the present embodiment, each of the first balance plates 2 has a first top plate 21 which is rectangular, and two first side plates 22 attached to two ends of the first top plate 21. The two first side plates 22 are each substantially perpendicular to the first top plate 21, such that the first balance plate 2 is substantially U-shaped. The end of each of the first side plates 22 distal from the first top plate 21 is connected to the bottom board 1, and the first top plate 21 is connected to the key cap 3. Specifically, the free ends of the two first side plates 22 are each formed with a first sliding connection portion 221, whose structure is not limited. In the present embodiment each of the first sliding connection portions 221 is a plate protruding from the free end of the respective first side plate 22. The width of the first sliding portions 221 is smaller than the width of the first side plates 22.

A first reinforcement portion 23 can be disposed between the first top plate 21 and each of the two first side plates 22. The first reinforcement portions 23 can each form a slanted edge spanning from one of two ends of the first top plate 21 to one of the two first side plates 22, for increasing the strength of the first balance plate 2. A plurality of first pivot connection portions 211 are formed on each of the first top plates 21. The structure of the first pivot connection portions 211 is not limited. In the present embodiment the first pivot connection portions 211 are column shaped pivot shafts.

Figure 3:
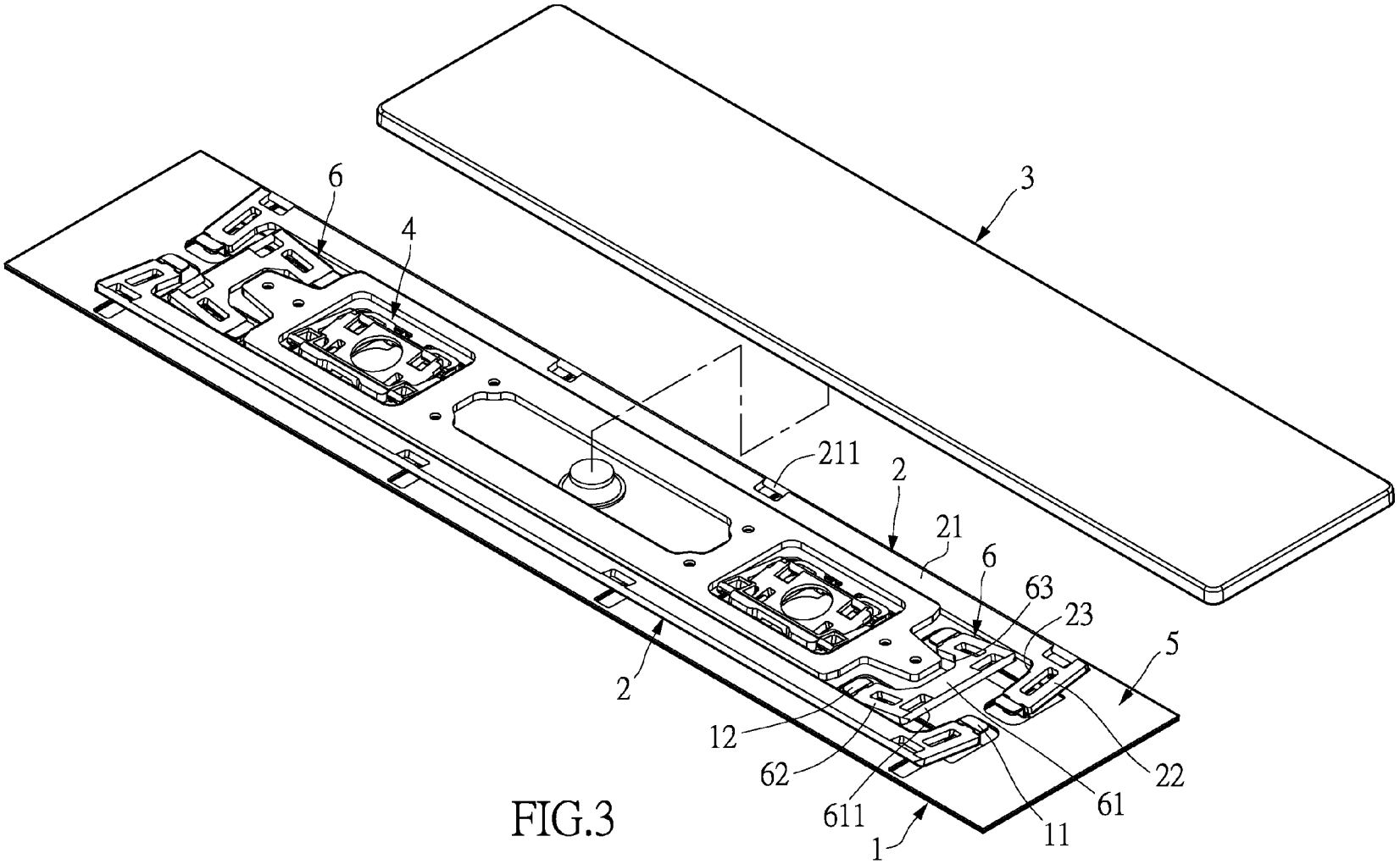
FIG. 3 shows a perspective view of a key structure according to the present disclosure wherein only a key cap is separated.
Figure 4:
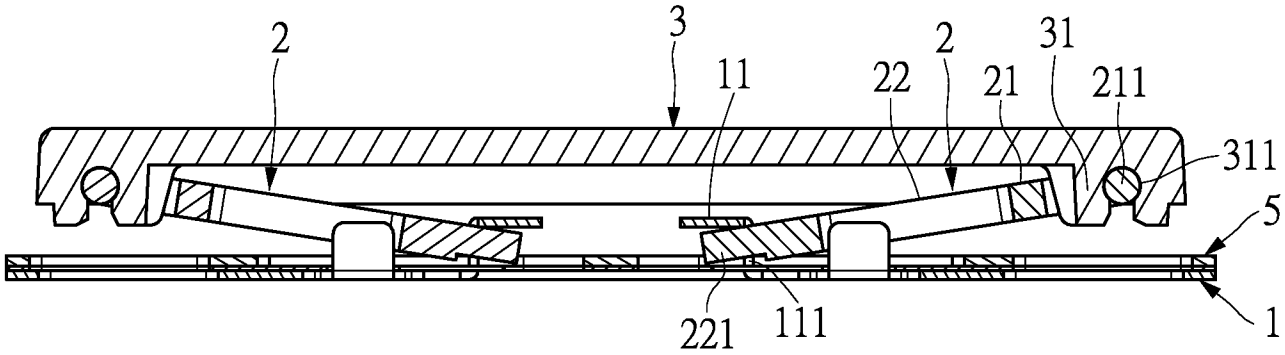
FIG. 4 shows a cross sectional view of a key structure according to the present disclosure.

Additionally, the bottom board 1 can have a plurality of second sliding connection portions 11 configured to engage the first sliding connection portions 221. The second sliding connection portions 11 are integrally formed with the bottom board 1, and their structure is not limited. In the present embodiment, the second sliding portions 11 are each plates bent into an L shape and formed with a first sliding slot 111. Referring to FIG. 3 and FIG. 4, the first sliding connection portions 221 of the first balance plates 2 are slidably disposed in the respective second sliding connection portions 11 on the bottom board 1. Namely, the first sliding connection portions 221 are disposed in the respective first sliding slots 111, thereby slidably connecting the lower ends of the two first balance plates 2 to the bottom board 1. The first sliding connection portions 221 can slide back and forth in the respective second sliding connection portions 11 (along the direction of the y-axis as shown in FIG. 1). In another embodiment, the structures of the first sliding connection portions 221 and the second sliding connection portions 11 can be interchanged, or replaced by other slidable connection structures.

Additionally, the key cap 3 can have a plurality of second pivot connection portions 31 configured to engage the first pivot connection portions 211. The second pivot connection portions 31 are integrally formed with the key cap 3. The second pivot connection portions 31 can be formed at the edges of the underside of the key cap 3, and their structure is not limited. In the present embodiment, the second pivot connection portions 31 are bases protruding from the underside of the key cap 3, and are each formed with a first pivot hole 311. The first pivot connection portions 211 of the first balance plates 2 can be pivotally connected to the respective second pivot connection portions 31. Namely, the first pivot connection portions 211 can be respectively pivotally connected in the first pivot holes 311, thereby pivotally connecting the upper end of the two first balance plates 2 to the key cap 3. In another embodiment, the structures of the first pivot connection portions 211 and the second pivot connection portions 31 can be interchanged, or replaced by other structures.

Shorter key structures usually require only two first balance plates 2. The present embodiment discloses a longer key structure. Therefore two second balance plates 6 are disposed. The two second balance plates 6 are preferably metal plates (e.g. stainless steel) but are not limited thereto. The two second balance plates 6 can be short corresponding to the width of the key cap 3. The thickness of the second balance plates 6 is preferably 0.3 mm to 0.6 mm but is not limited thereto. The two second balance plates 6 are disposed between the bottom board 1 and the key cap 3, are symmetric to each other, and arranged proximal to the respective ends of the two first balance plates 2. An upper end of each of the two second balance plates 6 is connected to the key cap 3, and a lower end of each of the two second balance plates 6 is connected to the bottom board 1. In the present embodiment, the upper end of each of the two second balance plates 6 is pivotally connected to the key cap 3, and the lower end of each of the two second balance plates 6 is slidably connected to the bottom board 1. However, the method of connection between the two second balance plates 6 and the bottom board 1 and between the two second balance plates 6 and the key cap 3 is not limited and can be modified according to need. For example, the upper ends of the two second balance plates 6 can be slidably connected to the key cap 3, and the lower ends of the two second balance plates 6 can be pivotally connected to the bottom board 1.

In the present embodiment, each of the second balance plates 6 has a second top plate 61 which is rectangular, and two second side plates 62 attached to two ends of the second top plate 61. The two second side plates 62 are each substantially perpendicular to the second top plate 61, such that the second balance plate 6 is substantially U-shaped. The end of each of the second side plates 62 distal from the second top plate 61 is connected to the bottom board 1, and the second top plate 61 is connected to the key cap 3. Specifically, the free ends of the two second side plates 62 are each formed with a third sliding connection portion 621, whose structure is not limited. In the present embodiment each of the third sliding connection portions 621 is a plate protruding from the free end of the respective second side plate 62. The width of the third sliding portions 621 is smaller than the width of the second side plates 62.

A second reinforcement portion 63 can be disposed between the second top plate 61 and each of the two second side plates 62. The second reinforcement portions 63 can each form a slanted edge spanning from one of two ends of the second top plate 61 to one of the two second side plates 62, for increasing the strength of the first balance plate 2. A plurality of third pivot connection portions 611 are formed on each of the second top plates 61. The structure of the third pivot connection portions 611 is not limited. In the present embodiment the third pivot connection portions 611 are column shaped pivot shafts.

Figure 5:
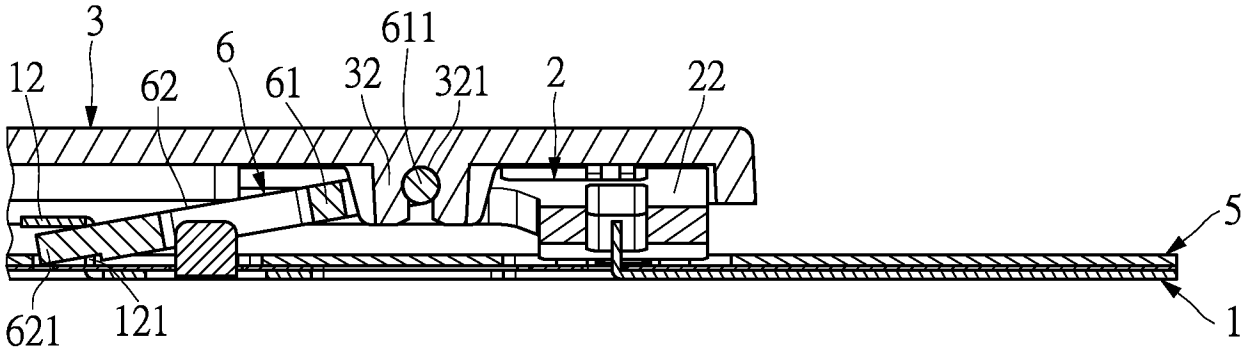
FIG. 5 shows another cross sectional view of a key structure according to the present disclosure.

Additionally, the bottom board 1 can have a plurality of fourth sliding connection portions 12 configured to engage the third sliding connection portions 621. The fourth sliding connection portions 12 are integrally formed with the bottom board 1, and their structure is not limited. In the present embodiment, the fourth sliding portions 12 are each plates bent into an L shape and formed with a second sliding slot 121. Referring to FIG. 3 and FIG. 5, the third sliding connection portions 621 of the second balance plates 6 are slidably disposed in the respective fourth sliding connection portions 12 on the bottom board 1. Namely, the third sliding connection portions 621 are disposed in the respective second sliding slots 121, thereby slidably connecting the lower ends of the two second balance plates 6 to the bottom board 1. The third sliding connection portions 621 can slide back and forth in the respective fourth sliding connection portions 12 (along the direction of the x-axis as shown in FIG. 1). In another embodiment, the structures of the third sliding connection portions 621 and the fourth sliding connection portions 12 can be interchanged, or replaced by other slidable connection structures.

Additionally, the key cap 3 can have a plurality of fourth pivot connection portions 32 configured to engage the third pivot connection portions 611. The fourth pivot connection portions 32 are integrally formed with the key cap 3. The fourth pivot connection portions 32 can be formed at the edges of the underside of the key cap 3, and their structure is not limited. In the present embodiment, the fourth pivot connection portions 32 are bases protruding from the underside of the key cap 3, and are each formed with a second pivot hole 321. The third pivot connection portions 611 of the second balance plates 6 can be pivotally connected to the respective fourth pivot connection portions 32. Namely, the third pivot connection portions 611 can be respectively pivotally connected in the second pivot holes 321, thereby pivotally connecting the upper end of the two second balance plates 6 to the key cap 3. In another embodiment, the structures of the third pivot connection portions 611 and the fourth pivot connection portions 32 can be interchanged, or replaced by other structures.

Additionally, in the present embodiment, the two second balance plates 6 are arranged between the two first balance plates 2, such that the two second balance plates 6 are positioned at inner sides of the two first balance plates 2. However, the two second balance plates 6 can alternately be arranged at outer sides of the first balance plates 2. Namely, the arrangements of the first balance plates 2 and the second balance plates 6 can be modified according to need, and are not limited.

In the present embodiment, a strengthening plate is disposed under the key cap 3. The strengthening plate 7 is preferably a metal plate (e.g. a stainless steel plate) but is not limited thereto. The thickness of the strengthening plate is preferably 0.3 mm to 0.6 mm but is not limited thereto. The strengthening plate 7 can be fixed to the underside of the key cap 3 by adhesives or fusing, for increasing the strength of the key cap 3 such that the key cap 3 is not easily damaged. The strengthening plate 7 can be rectangular and be formed with a plurality of openings 71 such that the strengthening plate 7 is hollow.

Figure 6:
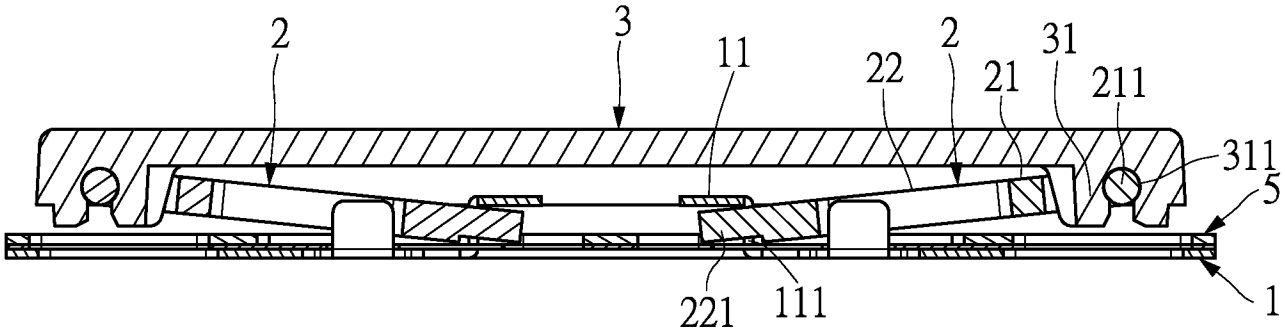
FIG. 6 shows a cross sectional view of the key structure of FIG. 4 in a pressed state.
Figure 7:
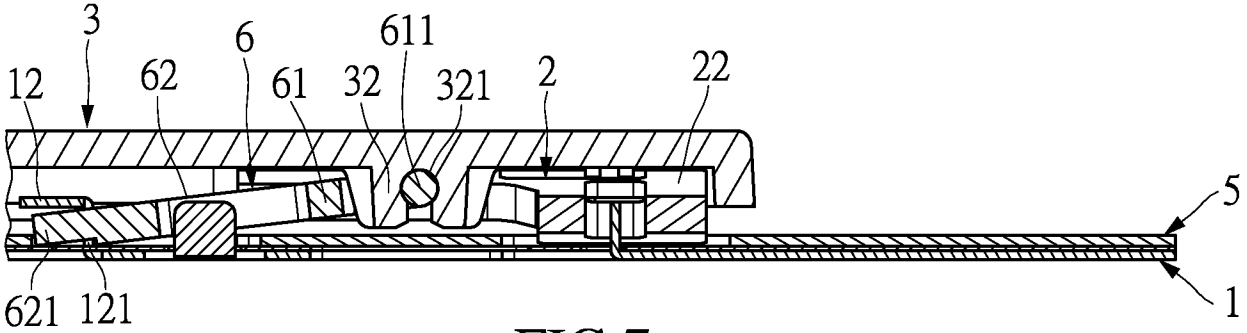
FIG. 7 shows a cross sectional view of the key structure of FIG. 5 in a pressed state.

Referring to FIG. 6 and FIG. 7, when the key structure is pressed, the balance mechanism formed by the first balance plates 2 and the second balance plates 6 can evenly distribute the force over the entire key cap 3, such that the key cap 3 is kept horizontal and parallel to the bottom board 1 during motion, preventing flipping of the key cap 3 which results in poor responsiveness. The two first balance plates 2 can strengthen the key structure across a left-right direction (direction of x-axis as shown in FIG. 1), and the two second balance plates 6 can strengthen the key structure across a front-back direction (direction of y-axis as shown in FIG. 1).

The present disclosure uses plate shaped balance plates to replace traditional link bars having circular cross sections, providing additional strength in a same amount of space. For example, a balance plate having a thickness of 0.5 mm can achieve a same strength as that of a traditional link bar having a thickness of over 1 mm. An ideal tactile feel at four corners of the key structure is achieved while saving space through an effective geometrical design. A normal tactile feel is provided while saving space, thereby achieving a slim design. The height of the key structure of the present disclosure can be reduced to 2.5 mm to 3.0 mm.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A key structure with two pairs of Symmetric balance plates, comprising:

a bottom board;

a key cap, having two first sides along a first direction and two second sides along a second direction, the first side being longer than the second side;

a strengthening plate, fixed on an underside of the key cap, being rectangular and formed with at least one opening, having two first sides along the first direction and two second sides along the second direction;

at least one scissor switch, disposed between the bottom board and the key cap corresponding to the at least one opening of the strengthening plate, wherein the at least one scissor switch is a two-bar balance structure to guide the key cap in up and down motions and balancing a force applied to the key cap; and two first balance plates, being plate shaped disposed between the bottom board and the key cap, are symmetric to each other, wherein each of the first balance plates is U-shaped and has a upper side and two free ends configured to symmetrically surround the strengthening plate, wherein the upper side of each of the first balance plates is connected to the key cap beside the first side of the strengthening plate, and the two free ends of each of the first balance plates are extending from two ends of the upper side beside the second side of the strengthening plate and connected to the bottom board.

2. The key structure with two pairs of Symmetric balance plates to claim 1, wherein a thickness of the first balance plates is 0.3 mm to 0.6 mm.

3. The key structure with two pairs of Symmetric balance plates to claim 1, wherein the first balance plates each have a first top plate and two first side plates respectively connected to two ends of the first top plate, an end of each of the two first side plates distal from the first top plate is connected to the bottom board, and the first top plate is connected to the key cap.

4. The key structure with two pairs of Symmetric balance plates to claim 3, wherein the end of each of the two first side plates distal from the first top plate is formed with a first sliding connection portion, the bottom board has a plurality of second sliding connection portions configured to respectively engage the first sliding connection portions, and the first sliding connection portions are slidably disposed in the respective second sliding connection portions on the bottom board.

5. The key structure with two pairs of Symmetric balance plates to claim 3, wherein the first top plates are each formed with a plurality of first pivot connection portions, the key cap has a plurality of second pivot connection portions configured to engage the first pivot connection portions, and the first pivot connection portions are pivotally connected to the respective second pivot connection portions on the key cap.

6. The key structure with two pairs of Symmetric balance plates according to claim 5, wherein the first pivot connection portions are column-shaped pivot shafts.

7. The key structure with two pairs of Symmetric balance plates to claim 3, wherein each of the first top plates further has a first reinforcement portion disposed between the first top plate and each of the two first side plates, each of the first reinforcement portions forms a slanted edge spanning from one of two ends of the first top plate to one of the two first side plates, so as to increase a strength of the first balance plate.

8. The key structure with two pairs of Symmetric balance plates according to claim 1, further comprising two second balance plates disposed between the bottom board and the key cap, wherein the two second balance plates are symmetric to each other;

wherein each of the second balance plates is U-shaped and has a upper side and two free ends, the upper side of each of the second balance plates is connected to the key cap along the second direction, and two free ends of each of the second balance plates are connected to the bottom board;

wherein the two second balance plates are disposed at two opposite sides of the strengthening plate and arranged between the two first balance plates;

wherein an extending direction of the upper side of the first balance plate is perpendicular to an extending direction of the upper side of the second balance plate.

9. The key structure with two pairs of Symmetric balance plates to claim 8, wherein a thickness of the second balance plates is 0.3 mm to 0.6 mm.

10. The key structure with two pairs of Symmetric balance plates to claim 9, wherein the second balance plates each have a second top plate and two second side plates respectively connected to two ends of the second top plate, an end of each of the two second side plates distal from the second top plate is connected to the bottom board, and the second top plate is connected to the key cap;

wherein the second top plates of the two second balance plates are respectively disposed adjacent to the first side plates of the two first balance plates.

11. The key structure with two pairs of Symmetric balance plates to claim 10, wherein the end of each of the two second side plates distal from the second top plate is formed with a third sliding connection portion, the bottom board has a plurality of fourth sliding connection portions configured to respectively engage the third sliding connection portions, and the third sliding connection portions are slidably disposed in the respective fourth sliding connection portions on the bottom board.

12. The key structure with two pairs of Symmetric balance plates according to claim 10, wherein the second top plates are each formed with a plurality of third pivot connection portions, the key cap has a plurality of fourth pivot connection portions configured to engage the third pivot connection portions, and the third pivot connection portions are pivotally connected to the respective fourth pivot connection portions on the key cap.

13. The key structure with two pairs of Symmetric balance plates according to claim 12, wherein the third pivot portions are column-shaped pivot shafts.

14. The key structure with two pairs of Symmetric balance plates to claim 10, wherein each of the second balance plates further has a second reinforcement portion disposed between the second top plate and each of the two second side plates, wherein each of the second reinforcement portions forms a slanted edge spanning from one of two ends of the second top plate to one of the two second side plates, so as to increase a strength of the first balance plate.

* * * * *